US006148915A

United States Patent [19]

Mullen et al.

[11] Patent Number: 6,148,915

[45] Date of Patent: Nov. 21, 2000

[54] APPARATUS AND METHODS FOR COMPLETING A SUBTERRANEAN WELL

[75] Inventors: Byron D. Mullen, Carrollton, Tex.; Peter A. Duhon, Harvey, La.

[73] Assignee: Halliburton Energy Services, Inc., Dallas, Tex.

[21] Appl. No.: 09/062,785

[22] Filed: Apr. 16, 1998

[51] Int. Cl.[7] ..... E21B 43/04

[52] U.S. Cl. ..... 166/278; 166/51; 166/205; 166/334.4; 166/321; 166/325; 137/68.16

[58] Field of Search ..... 166/276, 278, 166/51, 321, 325, 334.4, 205; 137/68.16, 71

[56] References Cited

U.S. PATENT DOCUMENTS 3,054,415 9/1962 Baker et al. ..... 137/68.16
4,440,218 4/1984 Farley ..... 166/51
4,478,286 10/1984 Fineberg ..... 166/324
4,889,199 12/1989 Lee ..... 175/317
5,579,844 12/1996 Rebardi et al. ..... 166/296
5,609,204 3/1997 Rebardi et al. ..... 166/51

*Primary Examiner*—William Neuder
*Assistant Examiner*—Zakiya Walker
*Attorney, Agent, or Firm*—William M. Imwalle; J. Richard Konneker

[57] ABSTRACT

Methods and apparatus provide desired levels of continuous fluid pressure in a portion of a wellbore during completion operations. In a described embodiment, a method permits continuous fluid communication between a tubular string extending to the earth's surface and a portion of a wellbore below a packer during testing of the packer. This fluid communication enables a desired fluid pressure to be continually applied to a filter cake lining the portion of the wellbore, to aid in preventing compromise of the filter cake and possible collapse of the wellbore portion. A packer test device included in the apparatus permits such fluid communication during testing of the packer.

44 Claims, 5 Drawing Sheets

APPARATUS AND METHODS FOR COMPLETING A SUBTERRANEAN WELL

BACKGROUND OF THE INVENTION

The present invention relates generally to operations performed in conjunction with subterranean wells and, in an embodiment described herein, more particularly provides methods and apparatus useful in gravel packing operations.

Frequently, a horizontal or highly deviated portion of a wellbore is completed without being lined with protective casing and cement. If the wellbore portion intersects an unconsolidated or very low strength formation from which it is desired to produce fluids, it may be desirable to perform a completion operation known as gravel packing. In a gravel packing operation, sand or other particulate material is flowed into an annular space formed radially between the wellbore and one or more screens attached to a special purpose packer set in the wellbore. The sand and screens act to prevent the formation from breaking up and flowing to the earth's surface along with the fluids produced from the formation.

In some horizontal or highly deviated uncased wellbore completions, a "filter cake" is applied to the walls of the wellbore to aid in stabilizing the formation intersected by the wellbore. The filter cake temporarily prevents breaking up of the formation or, ultimately, collapse of the formation during completion operations. In some cases, the filter cake may be a gelatinous material spotted across the uncased wellbore, or it may be material conveyed to the uncased wellbore by mud circulation, etc.

In order for the filter cake to provide maximum stabilization of the formation it is generally desirable for positive pressure to be applied from the wellbore to the formation. That is, fluid pressure in the wellbore should exceed fluid pressure in the formation by a desired amount. This positive pressure acts, in essence, to press the filter cake against the formation. Thus, although the filter cake is not generally pressure-tight, if a positive pressure is continuously applied to the filter cake, the filter cake will provide adequate support to prevent damage to the formation.

Unfortunately, conventional gravel packing operations do not permit a positive pressure to be continuously applied to the filter cake. Each of these operations, therefore, runs the risk that the formation will become sufficiently destabilized during the operation to cause damage to the formation. This may result in the operation being aborted, equipment being caught in a collapsed wellbore, etc., each of which would require great time and expense to remedy.

Therefore, it would be quite desirable to provide methods and apparatus for completing a subterranean well which permit continuous application of positive pressure to a wellbore. Such methods and apparatus would be particularly desirable in gravel packing operations performed in uncased portions of horizontal or highly deviated wellbores intersecting unconsolidated or very low strength formations in which filter cakes are utilized to stabilize the formations, although the methods and apparatus would be quite useful in other operations as well.

SUMMARY OF THE INVENTION

In carrying out the principles of the present invention, in accordance with an embodiment thereof, a method of completing a subterranean well is provided in which continuous fluid communication is established with a portion of a wellbore intersecting a formation. Associated apparatus is also provided.

In one aspect of the present invention, a gravel packing operation is performed in which a tubular string is attached to a gravel packing assembly including a packer, a screen and a packer testing device. As the gravel packing assembly is lowered into the well suspended from the tubular string, fluid is circulated through the tubular string, thereby "washing in" the gravel packing assembly and maintaining positive pressure on a filter cake lining an uncased portion of the wellbore. The packer is set in the well and then pressure tested to verify that is has properly set. The testing operation is accomplished by applying fluid pressure to an annulus between the tubular string and the wellbore, while maintaining positive fluid pressure on the filter cake via the tubular string. After the packer has been tested, the wellbore is gravel packed by flowing a gravel slurry through the tubular string to an annulus between the screen and the uncased wellbore. In this manner, positive pressure is continuously applied to the filter cake, thereby preventing damage to the formation intersected by the wellbore.

In another aspect of the present invention, an apparatus is provided which establishes continuous fluid communication with a portion of a wellbore during completion operations. The described embodiment of the apparatus includes a packer testing device. The device permits fluid communication between the tubular string and the wellbore portion during pressure testing of a packer interconnected with the apparatus.

These and other features, advantages, benefits and objects of the present invention will become apparent to one of ordinary skill in the art upon careful consideration of the detailed description of a representative embodiment of the invention hereinbelow and the accompanying drawings.

DETAILED DESCRIPTION

Figure 1:
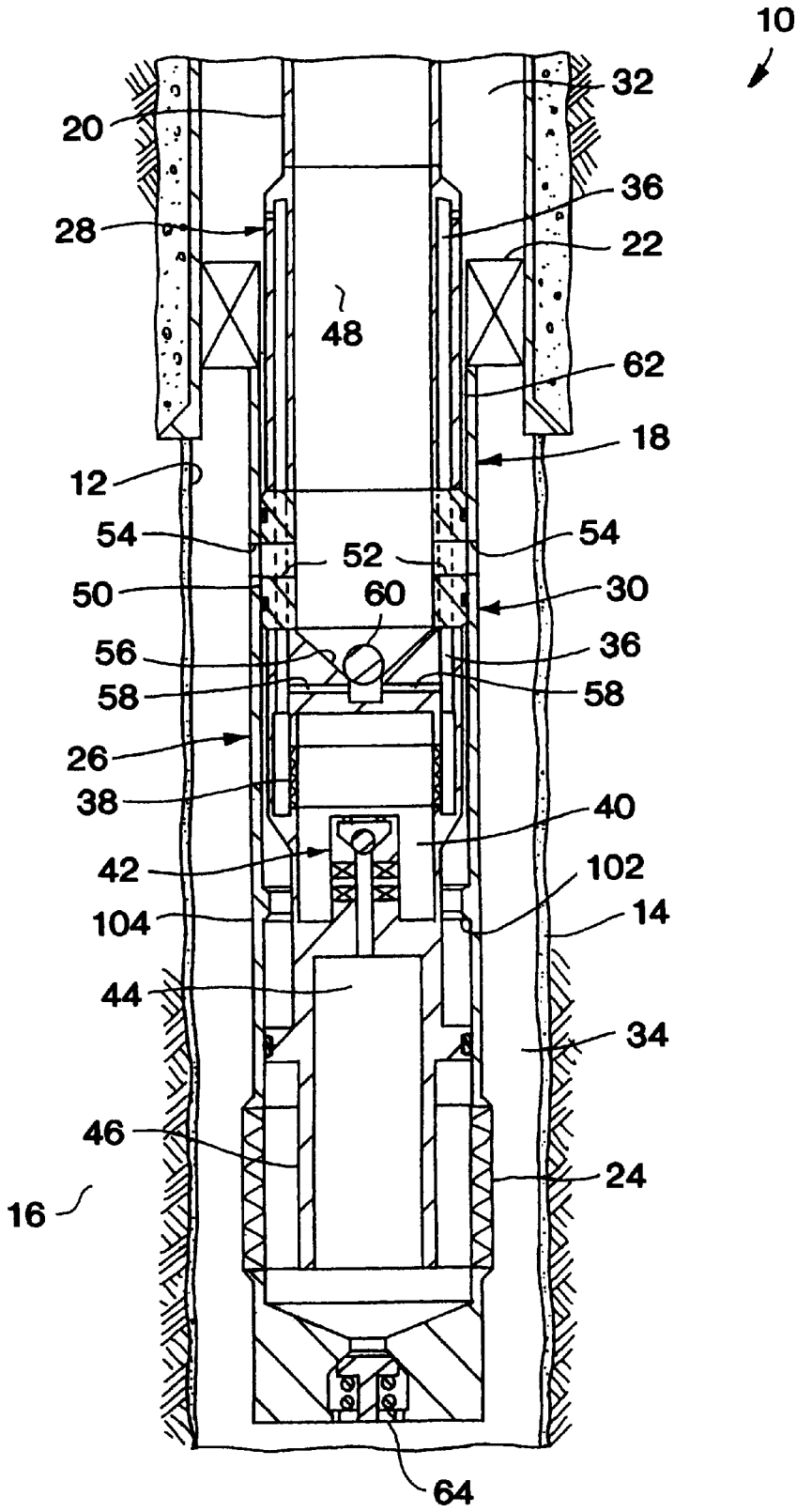
FIG. 1 is a schematic cross-sectional view of a method and apparatus, each embodying principles of the present invention.

Representatively and schematically illustrated in FIG. 1 is a method 10 of completing a subterranean well which embodies principles of the present invention. In the following description of the method 10 and other apparatus and methods described herein, directional terms, such as "above", "below", "upper", "lower", etc., are used for convenience in referring to the accompanying drawings. Additionally, it is to be understood that the various embodiments of the present invention described herein may be utilized in various orientations, such as inclined, inverted, horizontal, vertical, etc., without departing from the principles of the present invention.

For convenience and clarity of illustration and description, a wellbore 12 of the well is depicted in FIG. 1 as being generally vertical and having both cased and uncased portions. However, it is to be clearly understood that principles of the present invention may be incorporated in methods performed in wells having generally horizontal wellbores, highly deviated wellbores, wellbores with a combination of generally vertical and generally horizontal or highly deviated portions, fully cased wellbores, substantially uncased wellbores, and other types of wellbores. Additionally, a lower portion of the wellbore 12 is depicted in FIG. 1 as having a filter cake 14 or other formation stabilizing material deposited at an interface between the wellbore 12 and a formation 16 intersected by the wellbore, but it is not necessary for the filter cake to be present in keeping with the principles of the present invention.

The filter cake 14 is well known to those skilled in the art and is used to provide a degree of stabilization for the formation 16. The method 10 uniquely maintains a positive fluid pressure applied to the filter cake 14 during completion operations, thereby preventing damage to, or collapse of, the formation 16. Thus, fluid pressure in the wellbore 12 adjacent the filter cake 14 exceeds fluid pressure in the formation 16 during the completion operations.

In the representatively illustrated method 10, the wellbore 12 adjacent the formation 16 is gravel packed utilizing techniques similar in many respects to conventional gravel packing operations well known to those skilled in the art. For example, gravel packing operations utilizing a Versa-Trieve® packer in a gravel packing assembly with a Multi-Position Tool™ service tool are well known. The Versa-Trieve® packer and Multi-Position Tool™ are available from Halliburton Energy Services, Inc. of Duncan, Oklahoma. The operation of these tools is well known to those skilled in the art.

For gravel packing the well in the method 10, a gravel packing assembly 18 is conveyed into the wellbore 12 attached to a tubular string 20, such as a drill string, tubing string, work string, etc., and positioned generally opposite the formation 16. However, it is to be clearly understood that principles of the present invention may be incorporated in methods of performing other completion operations and other types of operations. For example, the operation performed may be a fracturing, acidizing or other type of stimulation operation.

The gravel packing assembly 18 includes a packer 22 and one or more well screens 24. The packer 22 and screen 24 are interconnected in an outer portion 26 of the gravel packing assembly 18. An inner portion 28 of the gravel packing assembly 18 is disposed longitudinally within the outer portion 26 and is axially displaceable relative thereto. The tubular string 20 is attached to the inner portion 28 and, in the embodiment shown in FIG. 1, the inner portion may be displaced relative to the outer portion 26 by manipulation of the tubular string at the earth's surface. Of course, other ways of displacing one portion of an assembly relative to another portion of an assembly may be utilized without departing from the principles of the present invention.

The inner and outer portions 28, 26 of the gravel packing assembly 18 cooperate for actuation of a flow directing mechanism 30 included in the gravel packing assembly. In basic terms, the flow directing mechanism 30 controls fluid communication and fluid flow between the interior of the tubular string 20, an upper annulus 32 formed between the wellbore 12 and the tubular string 20 above the packer 22 and extending to the earth's surface, a lower annulus 34 formed between the gravel packing assembly 18 and the wellbore below the packer, and the interior of the screen 24. In one unique aspect of the present invention, the flow directing mechanism 30 maintains the lower annulus 34 in substantially continuous fluid communication with the interior of the tubular string 20 or the upper annulus 32 during the completion operation. In this manner, fluid pressure in the lower annulus 34 may be regulated via the tubular string 20 or the upper annulus 32 at the earth's surface, so that positive pressure is maintained on the filter cake 14. In another unique aspect of the present invention, fluid communication between the tubular string 20 and the lower annulus 34 is maintained even during pressure testing of the packer 22 after it is set in the wellbore 12.

The flow directing mechanism 30 includes a number of flow passages, openings, valves, etc. in the gravel packing assembly 18, as described more fully below. It is to be clearly understood, however, that the flow directing mechanism 30 could be differently constructed, positioned, etc., from that representatively illustrated in the accompanying drawings, without departing from the principles of the present invention. For example, multiple elements could be combined, integrally formed elements could be separated, elements could be differently positioned and configured, elements could be differently arranged with respect to each other, different numbers of elements could be utilized, etc.

As representatively illustrated, the flow directing mechanism 30 includes a flow passage 36 extending from the upper annulus 32 and partially through the gravel packing assembly 18 to a screen 38. The screen 38 is used to filter fluid flowing from another interior flow passage 40 to the flow passage 36, but fluid may also flow from the flow passage 36 to the flow passage 40 through the screen 38. A packer testing device 42 controls fluid flow between the flow passage 40 and another interior flow passage 44 extending from the packer testing device to the interior of the screen 24 through a tubular washpipe 46 positioned within the screen 24. The flow directing mechanism 30 also includes an interior flow passage 48 extending between the interior of the tubular string 20 and the interior of a crossover sub 50 of the inner portion 28. When ports 52 formed laterally through a sidewall of the crossover sub 50 are placed in fluid communication with openings 54 formed laterally through a sidewall of the outer portion 26, fluid communication is established between the interior of the tubular string 20 and the lower annulus 34, as shown in FIG. 1. A tapered ball seat 56 permits selective shutting off of fluid communication between the flow passage 48 and the flow passage 36 via flow passages 58 extending therebetween.

FIG. 1 shows the gravel packing assembly 18 in a configuration in which a slurry of fluid and gravel may be flowed through the tubular string 20, through the flow passage 48, and outward into the lower annulus 34 through the ports 52 and openings 54 to deposit the gravel in the lower annulus. The fluid portion of the slurry is permitted to flow inwardly through the screen 24 into the flow passage 44, to the flow passage 40 through the packer testing device 42, through the screen 38 to the flow passage 36, and thence to the upper annulus 32 for return to the earth's surface. The packer 22 is set in the wellbore 12 to isolate the upper annulus 32 from the lower annulus 34. The packer 22 is depicted as being set in a cased portion of the wellbore 12, but it could be set in an uncased portion of the wellbore without departing from the principles of the present invention.

After the packer 22 has been set in the wellbore 12, but before the slurry is flowed through the tubular string 20 and gravel packing assembly 18 to deposit gravel in the lower annulus 34, the packer should be tested to determine whether it has been properly set in the wellbore 12. At this time, the crossover 50 (and the remainder of the inner portion 28) is downwardly displaced relative to the outer portion 26 as compared to that shown in FIG. 1, so that the ports 52 are no longer in fluid communication with the openings 54, but the openings are in fluid communication with the upper annulus 32 via a flow passage 62 represented in FIG. 1 as an annular space between the inner and outer portions 28, 26. A ball 6() or other plugging member is installed in the gravel packing assembly 18 when the packer 22 is set and sealingly engages the seat 56 to close off fluid communication between the flow passage 48 and the flow passage 36.

Thus, when the packer 22 is set, the upper annulus 32 is in fluid communication with the lower annulus 34 via the flow passage 62 and openings 54, and the tubular string 20 is not in fluid communication with the lower annulus due to the fact that the crossover 50 is downwardly displaced relative to the outer portion 26. At this point, positive pressure may be maintained on the filter cake 14 via the upper annulus 32. The packer 22 may not be pressure tested, since the upper annulus and lower annulus 34 are in fluid communication. However, the gravel packing assembly 18 includes features which permit the packer 22 to be tested, while simultaneously maintaining positive pressure on the filter cake 14.

The packer testing device 42 includes multiple valves which control fluid communication and fluid flow between the flow passage 40 and the flow passage 44. In a manner described more fully below, the packer testing device 42 permits the upper annulus 32 to be isolated from the lower annulus 34 when the packer 22 is tested. To test the packer 22 after it has been set in the wellbore 12, the inner portion 28 is displaced upwardly relative to the outer portion 26, so that the ports 52 are in fluid communication with the openings 54 as shown in FIG. 1, thereby providing fluid communication between the flow passage 48 and the lower annulus, and to actuate the packer testing device 42 to isolate the upper annulus 32 from the lower annulus 34. In this configuration, fluid pressure may be applied to the upper annulus 32 to test the packer 22 while positive pressure is maintained on the filter cake 14 via the tubular string 20.

The packer testing device 42 also permits fluid communication between the flow passage 40 and the flow passage 44 when the gravel packing assembly 18 is being conveyed into the wellbore 12, so that the gravel packing assembly may be "washed in" by circulating fluid from the interior of the tubular string 20, through the flow passage 48, through the flow passages 58 (the ball 60 is not present during conveyance of the gravel packing assembly into the wellbore), inward through the screen 38 to the flow passage 40, through the packer testing device 42 to the flow passage 44, and outward through a float shoe 64 or check valve at a lower end of the gravel packing assembly. From the float shoe 64, the fluid may be returned to the earth's surface by flowing upward between the gravel packing assembly 18 and the wellbore 12, and eventually to the earth's surface.

Thus, at least three configurations of the gravel packing assembly 18 are utilized in the method 10. In the first configuration, the inner portion 28 is downwardly displaced relative to the outer portion 26 as compared to that shown in FIG. 1, thereby preventing fluid communication between the ports 52 and the openings 54, and the gravel packing assembly 18 is washed in as it is conveyed into the wellbore 12. When properly positioned in the wellbore 12, the packer 22 is set by installing the ball 60 and applying fluid pressure to the flow passage 48 via the tubular string 20. The ball 60 sealingly engages the seat 56, preventing fluid communication between the flow passage 48 and the flow passage 36 via the flow passages 58. In the second configuration, the inner portion 28 is upwardly displaced relative to the outer portion 26, thereby actuating the packer testing device 42 to isolate the upper annulus 32 from the lower annulus 34, and permitting fluid communication between the flow passage 48 and the lower annulus 34 via the ports 52 and openings 54. In the third configuration, after the packer 22 has been tested and it is desired to gravel pack the lower annulus 34 between the screen 24 and the formation 16, the packer testing device 42 is again actuated to permit relatively unrestricted fluid communication between the lower annulus 34 and the upper annulus 32, to thereby permit flow of the fluid portion of the slurry from the flow passage 44 to the upper annulus 32 via the flow passages 40 and 36 at a high flow rate. Note that the float shoe 64 prevents flow of the slurry from the lower annulus 34 directly to the flow passage 44 during gravel packing.

Figure 2:
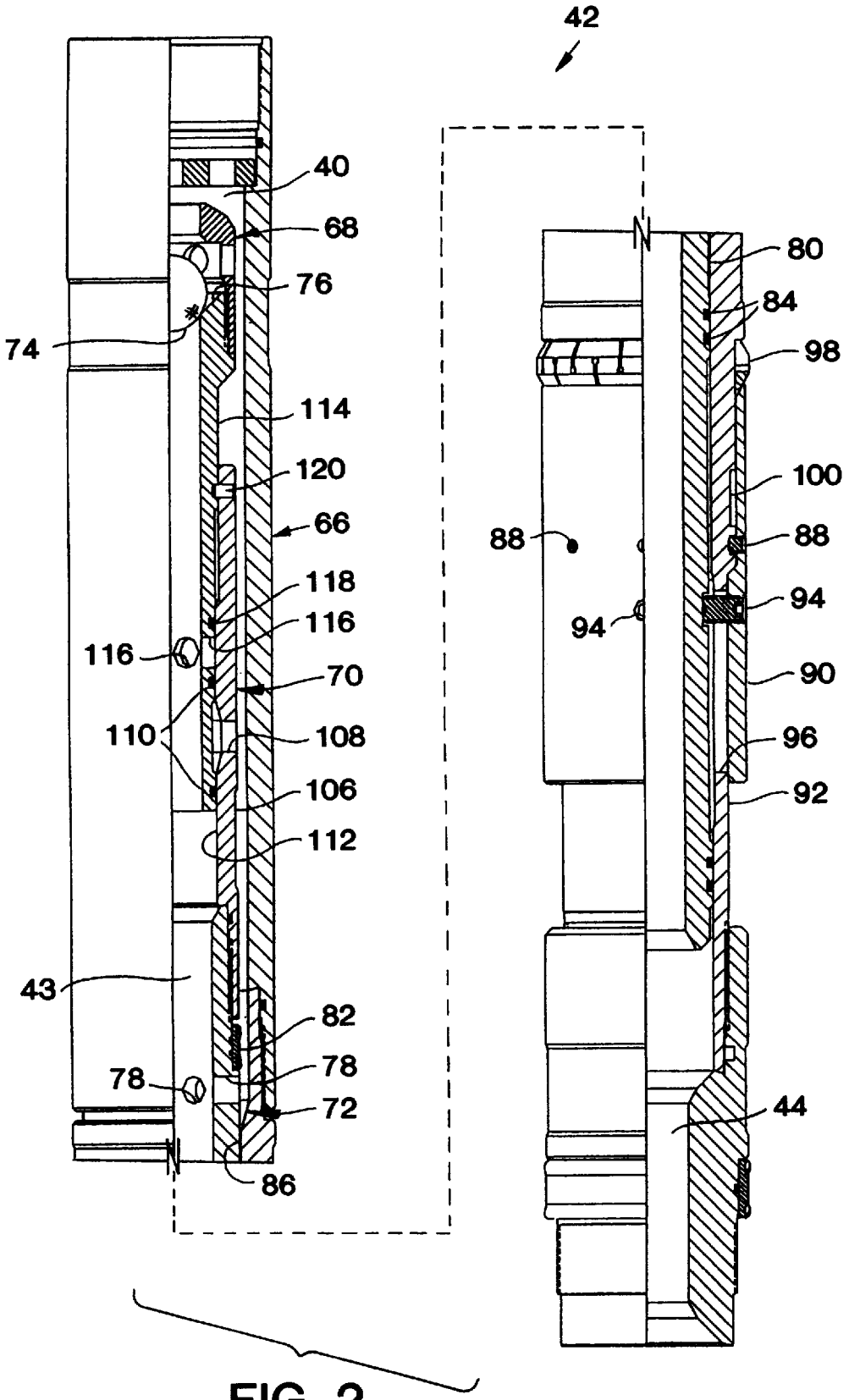
FIG. 2 is an enlarged scale quarter-sectional view of a packer testing device of the apparatus of FIG. 1, the device being shown apart from the remainder of the apparatus.

Referring additionally now to FIG. 2, the packer testing device 42 is representatively illustrated apart from the remainder of the gravel packing assembly 18. The packer testing device 42 includes a housing assembly 66, a check valve 68, and two sleeve valves 70, 72. The housing assembly 66 has the flow passages 40, 44 extending thereinto, which may be considered portions of an overall flow passage 43 extending longitudinally through the housing assembly for purposes of the following description of the packer testing device 42. As described above, the packer testing device 42 controls fluid flow and fluid communication between the flow passage 40 and the flow passage 44 of the gravel packing assembly 18. However, it is to be clearly understood that the packer testing device 42 may be utilized separately, or in other assemblies, without departing from the principles of the present invention.

The check valve 68 includes a ball 74 and a ball seat 76 configured for sealing engagement with the ball. The check valve 68 permits substantially unrestricted fluid flow from the flow passage 44 to the flow passage 40, but prevents or substantially restricts fluid flow from the flow passage 40 to the flow passage 44. Of course, other types of check valves, such as the float shoe 64, may be used in place of the check valve 68, without departing from the principles of the present invention.

As shown i n FIG. 2, the lower sleeve valve 72 is open, a series of openings 78 formed through a tubular lower mandrel 80 permitting fluid communication between the flow passages 40, 44. However, the lower mandrel 80 is axially reciprocably disposed within the housing assembly 66, and downward displacement of the lower mandrel relative to the housing assembly will cause flow through the openings 78 to be prevented due to sealing engagement of seals 82, 84 axially straddling the openings within an axial bore 86 formed in the housing assembly. The lower mandrel 80 is releasably secured against such downward displacement relative to the housing assembly 66 by a series of shear screws 88 installed through an outer sleeve 90 and into a generally tubular intermediate housing 92 of the housing assembly 66.

The outer sleeve 90 is attached to the lower mandrel 80 by means of a series of screws 94 installed through the sleeve, through a corresponding series of axially extending slots 96 (only one of which is visible in FIG. 2) formed through the intermediate housing 92, and into the lower mandrel 80. Thus, the sleeve 90 and the lower mandrel 80 displace together relative to the housing assembly 66.

To displace the sleeve 90 relative to the housing assembly 66, a predetermined downwardly directed force is applied to the sleeve 90 to shear the shear screws 88. The sleeve 90 and lower mandrel 80 may then be displaced downwardly relative to the housing assembly 66 to thereby close the sleeve valve 72 as described above.

The downwardly directed force is applied to the sleeve 90 via a radially extendable ring 98 or engagement structure axially slidingly disposed exteriorly on the intermediate housing 92. The force is applied to the ring 98, which transmits the force to the sleeve 90 and, when the shear screws 88 shear, the ring displaces downwardly with the sleeve. When the sleeve 90 has displaced downwardly a sufficient distance for the sleeve valve 72 to close (the seal 82 having entered and sealingly engaged the bore 86), the ring 98 radially compresses into an annular recess 100 formed externally on the intermediate housing 92. Thus, as shown in FIG. 2, the ring 98 is radially expanded, but radially compresses somewhat when it is displaced downwardly relative to the intermediate housing 92 so that it enters the recess 100.

In the gravel packing assembly 18 shown in FIG. 1, the downwardly directed force is applied to the ring 98 when the inner portion 28 is upwardly displaced relative to the outer portion 26 as described above. Such upward displacement of the inner portion 28 causes a radially reduced shoulder 102 or engagement profile formed internally on a tubular member 104 of the outer portion 26 to contact the ring 98. Further upward displacement of the inner portion 28 after the shoulder 102 contacts the ring 98 causes the downwardly directed force to be applied to the ring by the shoulder, shearing the shear screws 88. Still further upward displacement of the inner portion 28 after the shear screws 88 shear displaces the ring 98, sleeve 90, screws 94 and lower mandrel 80 downwardly relative to the intermediate housing 92, thereby closing the lower sleeve valve 72.

The lower sleeve valve 72 is closed in the method 10 after the packer 22 has been set and when it is desired to test the packer. In this manner, fluid pressure applied to the upper annulus 32 is not permitted to flow to the lower annulus 34, the packer testing device 42 preventing fluid flow from the flow passage 40 to the flow passage 44. This is due to the fact that both sleeve valves 70, 72 of the packer testing device 42 are closed at this point and the check valve 68 prevents fluid flow from the flow passage 40 to the flow passage 44.

The upper sleeve valve 70 includes a generally tubular upper mandrel 106 threadedly and sealingly attached to the lower mandrel 80, although it will be readily appreciated that the upper and lower mandrels could be integrally formed. A series of openings 108 (only one of which is visible in FIG. 2) formed laterally through the upper mandrel 106 and in fluid communication with the flow passage 40 are initially isolated from fluid communication with the flow passage 44 by seals 110 axially straddling the openings and sealingly engaged within an axial bore 112 formed internally on the upper mandrel 106. The seals 110 are carried externally on a tubular sleeve 114 axially reciprocably received within the upper mandrel 106.

The sleeve 114 has a series of openings 116 formed through a sidewall thereof in fluid communication with the flow passage 44, but the openings are isolated from fluid communication with the flow passage 40 by the seals 110 and a seal 118 sealingly engaged between the sleeve and the upper mandrel 106 opposite the openings from the seals 110. When the sleeve 114 is downwardly displaced relative to the upper mandrel 106 as described more fully below, the openings 116 are placed in fluid communication with the openings 108. Thus, downward displacement of the sleeve 114 relative to the upper mandrel 106 acts to open the sleeve valve 70, thus placing the flow passage 40 in fluid communication with the flow passage 4.

The sleeve 114 has the ball seat 76 formed on an upper end thereof. Thus, the sleeve valve 70 is cooperatively engaged with the check valve 68 in a manner more fully described below. The sleeve 114 is releasably secured against displacement relative to the upper mandrel 106 by one or more shear pins 120 installed through the upper mandrel and into the sleeve 114.

To open the sleeve valve 70, fluid pressure is applied to the flow passage 40 which is greater than fluid pressure in the flow passage 44 by a predetermined amount after the lower sleeve valve 72 has been closed as described above. This creates a pressure differential across the check valve 68. As will be readily appreciated by a person of ordinary skill in the art, this pressure differential results in a downwardly directed force being applied to the ball seat 76, causing the sleeve 114 to be downwardly biased thereby. The shear pins 120 shear when the predetermined pressure differential is achieved, thereby permitting the sleeve 114 to downwardly displace relative to the upper mandrel 106 and causing the openings 116 to be placed in fluid communication with the openings 108.

The upper sleeve valve 70 is opened as described above in the method 10 after the packer 22 has been tested and prior to flowing the slurry into the lower annulus 34 to deposit gravel between the screen 24 and the formation 16. In the gravel packing assembly 18, the predetermined differential fluid pressure is applied across the check valve 68 to open the upper sleeve valve 7() by applying fluid pressure to the upper annulus 32. Thus, after the packer 22 has been tested by applying a first level of fluid pressure to the upper annulus 32, the sleeve valve 70 may be opened by increasing the fluid pressure to a second level higher than the first level, to thereby apply the predetermined fluid pressure differential to the packer testing device 42 and again permit fluid communication between the upper annulus 32 and the lower annulus 34. Note that fluid flow from the lower annulus 34 to the upper annulus 32 is permitted through the packer testing device 42 via the check valve 68, however, by opening the sleeve valve 70 increased rates of fluid flow are permitted through the packer testing device.

The packer testing device 42 is in the configuration shown in FIG. 2 in the method 10 when the gravel packing assembly 18 is being conveyed into the wellbore 18. Since the lower sleeve valve 72 is open at this point, fluid flow is permitted from the flow passage 40 to the flow passage 44 as described above, thereby permitting the gravel packing assembly 18 to be washed in.

Figure 3:
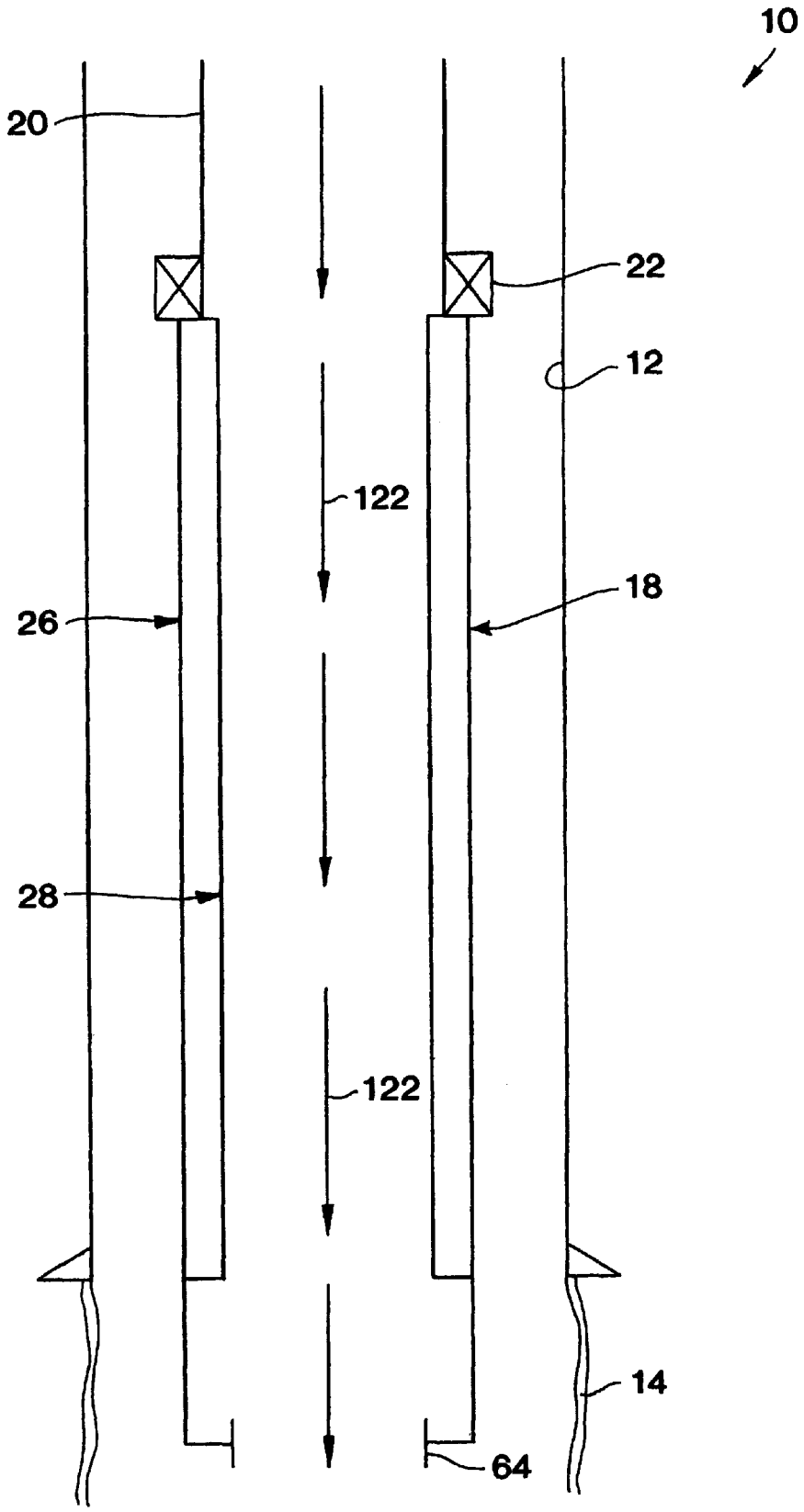
FIG. 3 is a highly schematicized view of the method and apparatus of FIG. 1, showing the apparatus as it is being run into a well.
Figure 4:
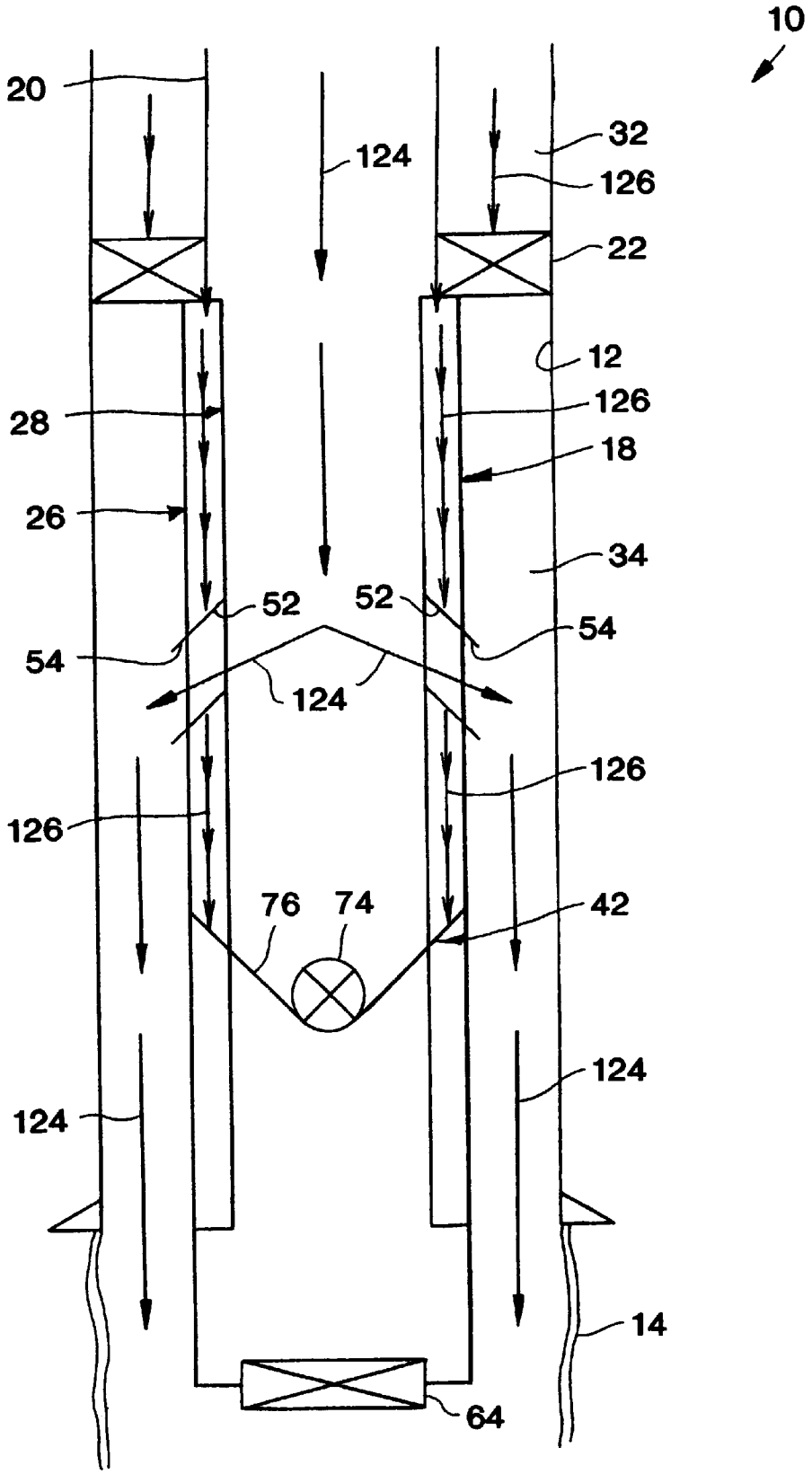
FIG. 4 is a highly schematicized view of the method and apparatus of FIG. 1, showing the apparatus as a packer thereof is being tested after having been set in the well.
Figure 5:
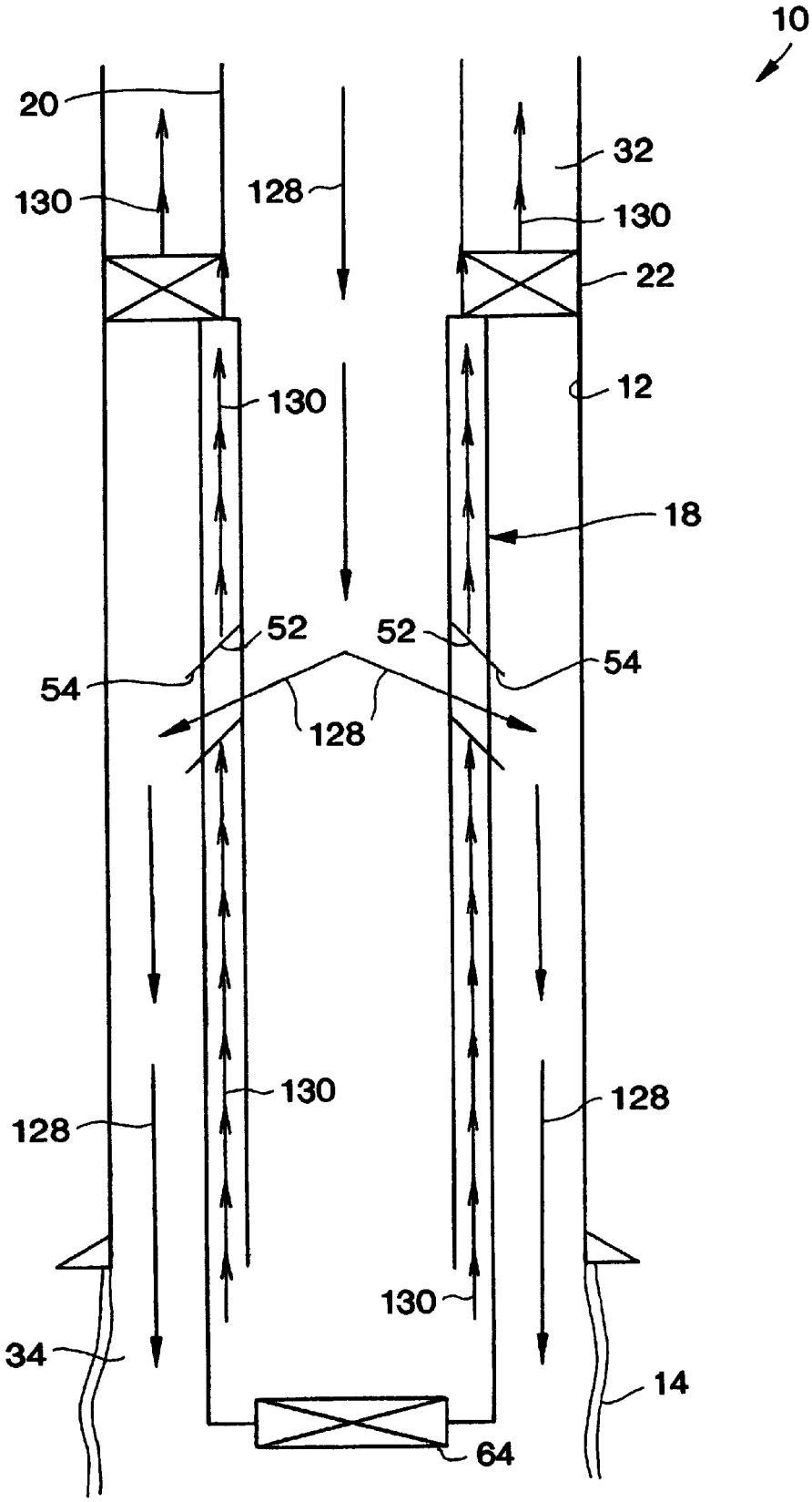
FIG. 5 is a highly schematicized view of the method and apparatus of FIG. 1, showing the apparatus during gravel packing of the well.

Referring additionally now to FIGS. 3–5, highly schematicized drawings of various configurations of the gravel packing assembly 18 in the wellbore 12 are shown, representatively illustrating fluid flows therethrough at corresponding various stages of the method 10.

FIG. 3 shows the method 10 wherein the gravel packing assembly 18 is being conveyed into the wellbore 12. Fluid (indicated by arrows 122) may be 5 flowed from the tubular string 20 through the gravel packing assembly 18, the fluid exiting the float shoe 64 and flowing into the wellbore 12. Fluid communication is present between the tubular string 20 and the wellbore 12, permitting positive pressure to be maintained on the filter cake 14. At this point, the lower sleeve valve 72 of the packer testing device 42 is open, thereby permitting the illustrated fluid flow 122 through the gravel packing assembly 18.

FIG. 4 shows the method 10 after the packer 22 has been set in the wellbore 12 and the inner portion 28 has been upwardly displaced relative to the outer portion 26. The ports 52 are now in fluid communication with the openings 54, thereby providing fluid communication between the tubular string 20 and the lower annulus 34 and permitting positive pressure to be maintained on the filter cake 14 during testing of the packer 22, as indicated by arrows 124. At this point, the lower sleeve valve 72 of the packer testing device 42 is closed, permitting fluid pressure (indicated by arrows 126) to be applied to the upper annulus 32, without its also being applied to the lower annulus 34. The ball 74 and seat 76 of the check valve 68 also prevent fluid flow from the flow passage 40 to the flow passage 44. Thus, the packer 22 may be tested while maintaining positive pressure on the filter cake 14.

FIG. 5 shows the method 10 after fluid pressure in the upper annulus 32 has been further increased to apply the predetermined differential pressure across the check valve 68, thereby opening the upper sleeve valve 70, and gravel packing of the lower annulus 34 has commenced. A slurry (indicated by arrows 128) may now be flowed from the tubular string 20 into the gravel packing assembly 18, outward through the ports 52 and openings 54, and into the lower annulus 34. After passing through the screen 24 (not shown in FIG. 5), a fluid portion (indicated by arrows 130) of the slurry 128 may flow through the check valve 68 and upper sleeve valve 70 of the packer testing device 42 and then to the upper annulus 32 for return to the earth's surface.

It may now be fully appreciated that the method 10, gravel packing apparatus 18, and packer testing device 42 incorporated therein, enable positive fluid pressure to be maintained on the filter cake 14 throughout the completion operation. This substantially reduces the risk of damage to, or collapse of, the formation 16. Specifically, the packer testing device 42 permits fluid communication between the tubular string 20 and the lower annulus 34 during testing of the packer 22 by application of fluid pressure to the upper annulus 32.

Of course, many modifications, additions, substitutions, deletions and other changes may be made to the representatively illustrated and described embodiments of the invention, which changes would be obvious to a person skilled in the art. For example, a number of element displacements have been described above as being directed axially or longitudinally, whereas such displacements could easily be made to be directed rotationally, laterally, helically, etc., without departing from the principles of the present invention. Accordingly, the foregoing detailed description is to be clearly understood as being given by way of illustration and example only, the spirit and scope of the present invention being limited solely by the appended claims.

What is claimed is:

1. A method of completing a subterranean well having a wellbore intersecting a formation, the method comprising the steps of:

conveying an assembly into the wellbore, the assembly including a packer, a tubular string engaged with the packer, a screen and a flow directing mechanism, the flow directing mechanism permitting fluid flow longitudinally through the assembly during conveyance into the wellbore;

setting the packer in the wellbore, thereby dividing a first annulus from a second annulus, the first and second annuli being formed between the assembly and the wellbore, the tubular string being positioned within the first annulus and the screen being positioned within the second annulus;

actuating the flow directing mechanism in one manner to isolate the first annulus from the second annulus while permitting fluid communication between the interior of the tubular string and the second annulus; and actuating the flow directing mechanism in another manner to permit fluid communication between the second annulus and the first annulus.

2. The method according to claim 1, wherein the step of actuating the flow directing mechanism to isolate the first annulus further comprises displacing the tubular string after the step of setting the packer.

3. The method according to claim 1, wherein the step of actuating the flow directing mechanism to permit fluid communication further comprises applying fluid pressure to the first annulus.

4. The method according to claim 1, wherein the flow directing mechanism includes a packer testing device, and wherein the step of actuating the flow directing mechanism to isolate the first annulus further comprises closing a valve of the packer testing device.

5. The method according to claim 1, wherein the flow directing mechanism includes a packer testing device, and wherein the step of actuating the flow directing mechanism to permit fluid communication further comprises opening a valve of the packer testing device.

6. The method according to claim 1, wherein the flow directing mechanism includes a packer testing device, and wherein the conveying step further comprises flowing the fluid through a valve of the packer testing device.

7. The method according to claim 1, wherein in the conveying, setting, and each of the actuating steps, positive pressure is applied to an interface between the wellbore and the formation.

8. The method according to claim 1, further comprising the step of testing the packer after the setting step by applying fluid pressure to the first annulus.

9. The method according to claim 8, wherein the testing step further comprises maintaining positive fluid pressure applied to an interface between the wellbore and the formation.

10. The method according to claim 1, wherein a filter cake is disposed at an interface between the wellbore and the formation, and further comprising the step of testing the packer by applying fluid pressure to the first annulus after the setting step and after the step of actuating the flow directing mechanism to isolate the first annulus, while maintaining positive fluid pressure applied to the filter cake.

11. A method of completing a subterranean well, the well having a wellbore intersecting a formation, the method comprising the steps of:

conveying a gravel packing assembly into the well, the gravel packing assembly including a packer and a well screen attached to the packer;

setting the packer in the wellbore, thereby dividing the wellbore into first and second portions; and testing the packer by applying fluid pressure to the first wellbore portion while simultaneously applying fluid pressure to the second wellbore portion external to the gravel packing assembly.

12. The method according to claim 11, wherein in the setting step, a tubular string attached to the gravel packing assembly is disposed within the first wellbore portion.

13. The method according to claim 12, wherein in the testing step, fluid pressure is applied to the second wellbore portion by providing fluid communication between the tubular string and the second wellbore portion.

14. The method according to claim 11, wherein the gravel packing assembly further includes a packer testing device, and wherein the testing step further comprises actuating the packer testing device to provide fluid communication between a tubular string attached to the gravel packing assembly and the second wellbore portion.

15. The method according to claim 11, further comprising the step of gravel packing by flowing a slurry through a tubular string engaged with the gravel packing assembly and into the second wellbore portion external to the screen.

16. A method of completing a subterranean well, the well having a wellbore intersecting a formation, the method comprising the steps of;

conveying a gravel packing assembly into the well, the gravel packing assembly including a packer and a well screen attached to the packer;

setting the packer in the wellbore, thereby dividing the well bore into first and second portions;

testing the packer by applying fluid pressure to the first wellbore portion while simultaneously applying fluid pressure to the second wellbore portion external to the gravel packing assembly; and gravel packing by flowing a slurry through a tubular string engaged with the gravel packing assembly and into the second wellbore portion external to the screen, wherein the gravel packing assembly further includes a packer testing device, wherein in the testing step the packer testing device prevents fluid communication between the first wellbore portion external to the tubular string and the second wellbore portion external to the screen, and wherein in the gravel packing step the packer testing device permits fluid flow from the second wellbore portion external to the screen, through the screen into the gravel packing assembly and then to the first wellbore portion external to the tubular string.

17. A method of completing a subterranean well, the well having a wellbore intersecting a formation, the method comprising the steps of;

conveying a gravel packing assembly into the well, the gravel packing assembly including a packer and a well screen attached to the packer;

setting the packer in the wellbore, thereby dividing the well bore into first and second portions;

testing the packer by applying fluid pressure to the first wellbore portion while simultaneously applying fluid pressure to the second wellbore portion external to the gravel packing assembly; and gravel packing by flowing a slurry through a tubular string engaged with the gravel packing assembly and into the second wellbore portion external to the screen, wherein the gravel packing assembly further includes a packer testing device, wherein in the testing step the packer testing device prevents fluid flow from the tubular string through the interior of the screen, and wherein in the gravel packing step the packer testing device permits fluid flow from the second wellbore portion through the screen and then to the first wellbore portion external to the tubular string.

18. A method of completing a subterranean well, the well having a wellbore intersecting a formation, the method comprising the steps of;

conveying a gravel packing assembly into the well, the gravel packing assembly including a packer and a well screen attached to the packer;

setting the packer in the wellbore, thereby dividing the well bore into first and second portions;

testing the packer by applying fluid pressure to the first wellbore portion while simultaneously applying fluid pressure to the second wellbore portion external to the gravel packing assembly; and gravel packing by flowing a slurry through a tubular string engaged with the gravel packing assembly and into the second wellbore portion external to the screen, wherein the gravel packing assembly further includes a packer testing device, and wherein the method further comprises the step of actuating the packer testing device after the testing step and before the gravel packing step.

19. The method according to claim 18, wherein the actuating step further comprises applying a predetermined fluid pressure differential to the packer testing device.

20. The method according to claim 18, wherein the packer testing device is interconnected in a first portion of the gravel packing assembly engaged with the tubular string, and the packer and screen are interconnected in a second portion of the gravel packing assembly, and further comprising the step of actuating the packer testing device after the setting step and before the testing step by displacing the first gravel packing assembly portion relative to the second gravel packing assembly portion.

21. Apparatus operatively positionable within a subterranean well, the apparatus comprising:

a generally tubular housing having a flow passage formed therethrough;

a first valve permitting fluid flow through the flow passage in a first direction but preventing fluid flow through the flow passage in a second direction opposite to the first direction;

a second valve interconnected to the first valve for movement relative thereto, the second valve permitting fluid flow therethrough when a predetermined fluid pressure is applied across the first valve; and a third valve preventing fluid flow therethrough when a portion thereof is displaced relative to the housing.

22. The apparatus according to claim 21, wherein the first valve is a check valve.

23. The apparatus according to claim 21, wherein the second valve includes first and second members, the first member being attached to the first valve, and the first member displacing relative to the second member, thereby opening the second valve, when the predetermined fluid pressure is applied across the first valve.

24. The apparatus according to claim 21, wherein the third valve includes a member releasably secured relative to the housing, the member displacing relative to the housing, thereby closing the third valve, when a predetermined force is applied to the member.

25. The apparatus according to claim 24, further comprising a structure releasably securing the member against displacement relative to the housing, the structure permitting relative displacement between the member and the housing when the predetermined force is applied to the member.

26. The apparatus according to claim 21, further comprising an engagement structure engaged with the third valve and a tubular member outwardly surrounding the housing, the tubular member having an engagement profile formed internally thereon, and the engagement structure engaging the engagement profile when the housing is displaced relative to the tubular member.

27. The apparatus according to claim 26, wherein the engagement structure is releasably secured against displacement relative to the housing, the engagement structure and third valve portion displacing relative to the housing when the engagement structure is engaged with the engagement profile and a predetermined force is applied to the engagement structure.

28. Apparatus operatively positionable within a subterranean well, the apparatus comprising:

a tubular housing assembly having a flow passage formed therethrough, the flow passage having first and second portions;

a check valve restricting fluid flow from the first to the second flow passage portion and permitting relatively unrestricted fluid flow from the second to the first flow passage portion; and a second valve, having a body portion carried by the check valve for movement relative thereto, for selectively permitting and preventing fluid flow from the first to the second flow passage portion in response to fluid pressure acting directly on the check valve.

29. Apparatus operatively positionable within a subterranean well, the apparatus comprising:

a tubular housing assembly having a flow passage formed therethrough, the flow passage having first and second portions;

a check valve restricting fluid flow from the first to the second flow passage portion and permitting relatively unrestricted fluid flow from the second to the first flow passage portion; and a second valve carried by the check valve for movement relative thereto and selectively permitting and preventing fluid flow from the first to the second flow passage portion in response to fluid pressure across the check valve, the second valve including first and second body portions, the first and second body portions displacing relative to each other when a predetermined fluid pressure is applied across the check valve.

30. The apparatus according to claim 29, wherein one of the first and second members is attached to a portion of the check valve.

31. The apparatus according to claim 30, wherein the check valve portion is a seat of the check valve.

32. The apparatus according to claim 29, wherein one of the first and second members is releasably secured against displacement relative to the housing assembly.

33. Apparatus operatively positionable within a subterranean well, the apparatus comprising:

a tubular housing assembly having a flow passage formed therethrough, the flow passage having first and second portions;

a check valve restricting fluid flow from the first to the second flow passage portion and permitting relatively unrestricted fluid flow from the second to the first flow passage portion; and a second valve selectively permitting and preventing fluid flow from the first to the second flow passage portion in response to fluid pressure across the check valve; and a third valve selectively permitting and preventing fluid flow from the first to the second flow passage portion in response to displacement of a portion of the third valve relative to the housing assembly.

34. The apparatus according to claim 33, wherein the third valve includes a member displacing relative to the housing assembly when a predetermined force is applied to the member.

35. The apparatus according to claim 34, wherein the member is attached to, and displaceable with, the third valve portion.

36. The apparatus according to claim 34, wherein the third valve member is disposed at least partially external to the housing assembly, the member being interconnected to the third valve portion and displaceable therewith.

37. The apparatus according to claim 36, wherein the member is releasably secured against displacement relative to the housing assembly.

38. Apparatus for use in completing a subterranean well, the apparatus comprising:

a tubular string; and a gravel packing assembly engaged with the tubular string, the gravel packing assembly including a packer, a screen and a packer testing device, the packer testing device being selectively configurable in a first configuration in which fluid flow is permitted from the tubular string then through the gravel packing assembly internal to the screen without first flowing external to the screen and a second configuration in which fluid flow from the tubular string is prevented from flowing through the gravel packing assembly internal to the screen.

39. The apparatus according to claim 38, wherein, in the second configuration, the packer testing assembly prevents fluid communication between the exterior of the tubular string opposite the packer from the screen and the interior of the screen when the packer is set in the well.

40. The apparatus according to claim 38, wherein the packer testing device is further selectively configurable in a third configuration in which fluid flow is permitted between the exterior of the tubular string opposite the packer from the screen and the interior of the screen when the packer is set in the well.

41. The apparatus according to claim 40, wherein the third configuration of the packer testing device is selectable in response to a predetermined fluid pressure difference between the exterior of the tubular string opposite the packer from the screen and the interior of the screen when the packer is set in the well.

42. The apparatus according to claim 38, wherein the second configuration of the packer testing device is selectable in response to displacement of the tubular string relative to a portion of the gravel packing assembly.

43. Apparatus operatively positionable within a subterranean wellbore opposite a formation intersected by the wellbore, the apparatus comprising:

an assembly having first and second opposite ends and including a packer, a screen, and a flow directing mechanism, the flow directing mechanism permitting fluid communication longitudinally through the interior of the assembly between the first and second opposite ends when the assembly is conveyed into the wellbore, and selectively permitting and preventing fluid communication between the interior of the screen and a first annulus formed between the assembly and the wellbore and extending to the earth's surface when the packer is set in the wellbore.

44. The apparatus according to claim 43, further comprising a tubular string attached to the assembly, and wherein the flow directing mechanism substantially continuously permits fluid communication between a second annulus formed between the screen and the wellbore when the packer is set in the wellbore and a selected one of the tubular string and the first annulus.

* * * * *